United States Patent [19]

Dorow et al.

[11] Patent Number: 4,809,607

[45] Date of Patent: Mar. 7, 1989

[54] APPARATUS FOR CLAMPING PRINTING PLATES

[75] Inventors: Joachim Dorow, Hassloch; Gerhard Bleckmann, Lampertheim, both of Fed. Rep. of Germany

[73] Assignee: BASF Aktiengesellschaft, Ludwigshafen, Fed. Rep. of Germany

[21] Appl. No.: 48,752

[22] Filed: May 12, 1987

[30] Foreign Application Priority Data

May 15, 1986 [DE] Fed. Rep. of Germany ..... 3616425

[51] Int. Cl.[4] ..... B41F 27/12

[52] U.S. Cl. ..... 101/415.1; 101/409

[58] Field of Search ..... 101/415.1, 409, 378, 101/383

[56] References Cited

U.S. PATENT DOCUMENTS

| | | | |
|---|---|---|---|
| 3,011,437 | 12/1961 | Hartmann | 101/415.1 |
| 3,058,417 | 10/1962 | Norlin | 101/415.1 |
| 4,596,188 | 6/1986 | Bonomi | 101/415.1 |
| 4,598,642 | 7/1986 | Sauer et al. | 101/415.1 |

FOREIGN PATENT DOCUMENTS

| | | | |
|---|---|---|---|
| 1125948 | 9/1959 | Fed. Rep. of Germany | 101/415.1 |
| 3401760 | 8/1985 | Fed. Rep. of Germany | 101/415.1 |
| 0238560 | 3/1969 | U.S.S.R. | 101/415.1 |

*Primary Examiner*—Edgar S. Burr
*Assistant Examiner*—Huong Q. Pham
*Attorney, Agent, or Firm*—Keil & Weinkauf

[57] ABSTRACT

Apparatus for clamping printing plates for rotary printing presses, having one or more clamping strips which are arranged so that they are laterally displaceable in a cylinder recess, which grip under an end region of the plate to be clamped and whose outer contour has a curvature corresponding to the cylinder curvature and is bordered by a pressure surface which engages a bent-over edge claw of the plate to be clamped, an insertable, resilient strip being inserted between the pressure surfaces of the clamping strips and a compression strip which is adjustable radially with respect to the cylinder circumference, wherein the clamping strip is adjustable in the clamping direction of the printing plates by means of two or more hydraulic cylinders which are supported at their rear and on the adjacent cylinder wall.

1 Claim, 1 Drawing Sheet

APPARATUS FOR CLAMPING PRINTING PLATES

BACKGROUND OF THE INVENTION AND PRIOR ART

The present invention relates to an apparatus for clamping printing plates (referred to as plates below) for rotary printing presses, having one or more clamping strips which are arranged so that they are laterally displaceable into a cylinder recess, which grip under an end region of the plate to be clamped and whose outer contour has a curvature corresponding to the cylinder curvature and is bordered by a pressure surface which engages a bent-over edge claw of the plate to be clamped, an insertable, resilient strip being inserted between the pressure surfaces of the clamping strips and a compression strip which is adjustable radially with respect to the cylinder circumference.

An apparatus of this type is disclosed in German Laid-Open Application DOS No. 3,401,760. This known apparatus consists of two clamping strips which are arranged in a cylinder recess, have an L-shaped cross-section and are displaceable toward one another or away from one another. The outer contour of the two clamping strips, i.e. the radially outer end surface of the limbs facing one another, has a curvature corresponding to the cylinder curvature. The radially outer edges, facing one another, of the two clamping strips are in the form of jaws having clamping surfaces which are bent over to form an acute angle with the peripheral contour and border a clamping channel which converges toward the outside. The horizontal limbs of the clamping strips face away from one another and engage an associated cylinder guide groove which is bordered on the one hand by the base of the recess and on the other hand by inserts which are provided in the region of the side walls of the cylinder recess and are engaged by the horizontal limbs of the clamping strips; this permits tilt-proof mounting and simple installation and removal of the clamping strips. The inserts, whose outer contours likewise correspond to the cylinder contour, are screwed to the cylinder.

The plate to be clamped is provided at its ends with edge claws which are bent at an acute angle and grip the clamping surfaces. In order to press the edge claws against the associated clamping surface, a strip is inserted into the clamping channel and in this case is in the form of a hard rubber or plastic strip which simultaneously acts as a sealing strip which seals the clamping channel radially toward the inside, so that the clamping channel can be filled after the plate has been clamped, this filling being required for gravure printing. The clamping strips have sufficient play with respect to the inserts to permit the edge claws of the plate being clamped, which are bent over at an acute angle, to be hooked over the associated jaws. To make it possible, nevertheless, to avoid a continuous slot between the back of the clamping strips and the particular adjacent cylinder wall, mutual dovetailing is provided. To displace the clamping strips in the clamping direction, a clamping spindle which is supported on the cylinder side, radially engages the back of the vertical limb of the clamping strips and extends continuously over the entire cylinder width is assigned to each of the clamping strips, the said spindle having a non-circular cross-section so that rotation of the clamping spindles produces a displacement of the associated clamping strip. The continuous clamping spindles are supported on the cylinder side over their entire length so that there is no sagging. Consequently, the peripheral contour of the two clamping strips automatically reaches the same position in every clamping operation. This ensures that there is no fluctuation in the cylinder circumference in the clamping position. The clamping spindles are provided at one end with a head which projects beyond the side of the cylinder and on which a key can be mounted, with the aid of which the clamping spindles can be rotated. By means of a special arrangement, the corresponding clamping spindle is fixed to prevent unintentional rotation, so that independent resetting from the clamped position to the relaxed position is not possible. The clamping strips can be reset to the initial position, for example, by arranging springs which are supported on those sides of the two clamping strips which face one another.

Where the apparatus described is used for clamping plates, three serious disadvantages in particular were observed in practice: firstly, the manual clamping of the clamping strips by means of a key, secondly, closing of the clamping channel (after the clamping strips have been clamped) with a gap-sealing material, and thirdly, the fact that the clamping strip and insert are dovetailed, entailing an expensive manufacturing procedure.

It is an object of the present invention to avoid the above disadvantages.

We have found that this object is achieved, according to the invention, if the clamping strip is adjustable in the clamping direction of the printing plates by means of two or more hydraulic cylinders which are supported at their rear and on the adjacent cylinder wall. The same applies to the adjustability of the clamping strip in the direction opposite to the clamping direction of the printing plate.

In an advantageous embodiment of the invention, the insertable, resilient strip is in the form of a plastic tube or hose filled with a gap-sealing material and having openings radially in the direction of the printing plate.

An embodiment of the invention is shown in the drawing and described in detail below.

DETAILED DESCRIPTION OF THE PREFERRED EMBODIMENT

Figure 1:
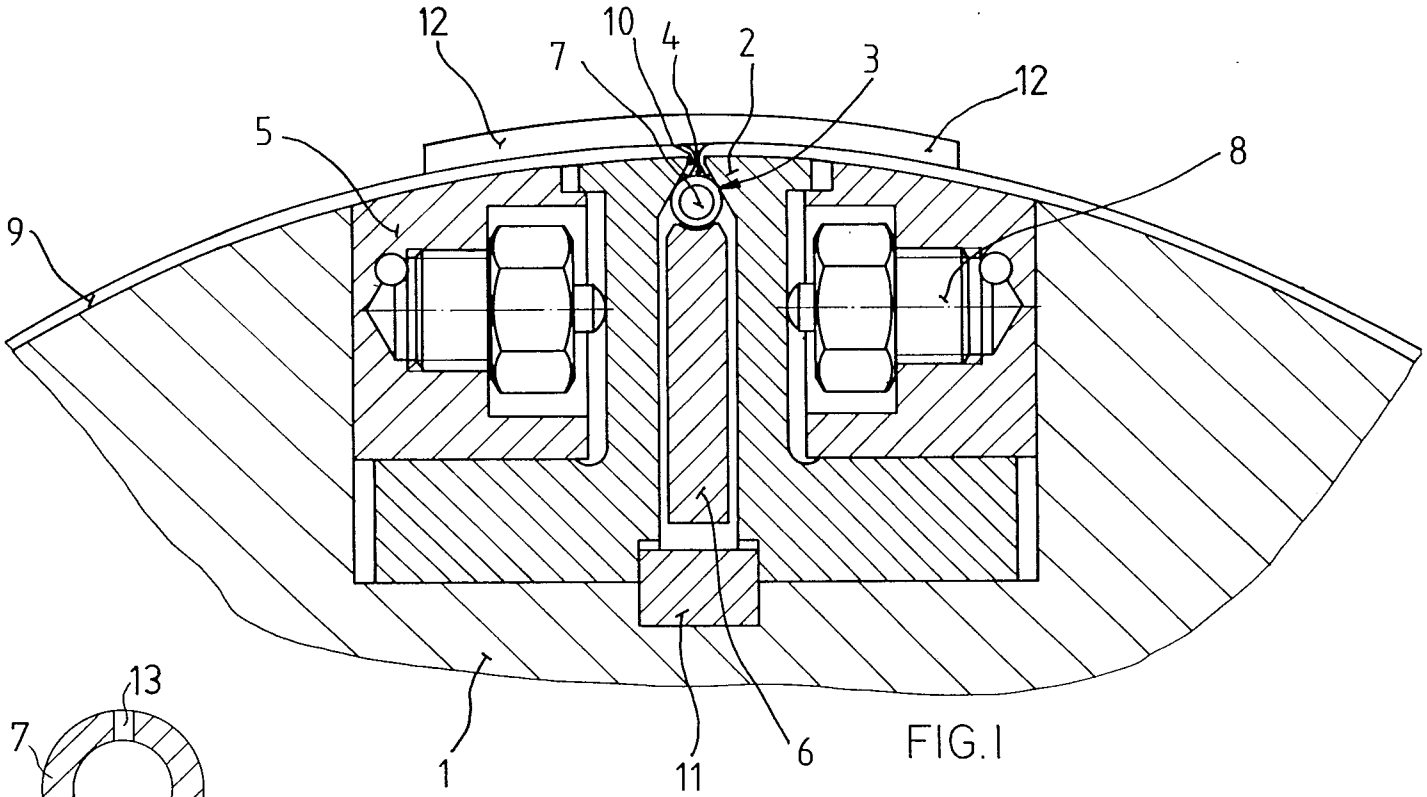
FIG. 1 is a radial section through the novel apparatus having 2 clamping strips.

The apparatus shown in the drawing essentially corresponds in its structure and its mode of operation to the apparatus as described in German Laid-Open Application DOS No. 3,401,760 and at the outset in this patent.

Figure 2:
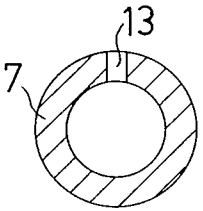
FIG. 2 is a cross-sectional view of the plastic tube or hose described below, this part being shown to a larger scale than in FIG. 1.

It essentially consists of the two clamping strips 2 which are arranged in a cylinder recess 1, are symmetrical with respect to a radial plane and have an L-shaped cross-section and in which the radially outer end surfaces of the vertical limbs facing one another have a curvature corresponding to the cylinder curvature. The radially outer edges of the two clamping strips face one another and are in the form of jaws having clamping surfaces 3 which are bent over to form an acute angle with the peripheral contour and border a clamping channel 4 which converges toward the outside. The horizontal limbs of the clamping strips face away from one another and engage an associated cylinder guide groove which is bordered on the one hand by the base of the recess and on the other hand by inserts 5 which are provided in the region of the side walls of the cylinder recess and engaged by the horizontal limbs of the clamping strips. These inserts, whose outer contours likewise correspond to the cylinder contour, are screwed to the cylinder. A plastic hose 7, a deformable tube or the like which is fitted with a gap-filling material and is provided over its entire length (corresponding to the cylinder length) with openings 13, FIG. 2, in the direction of the plate to be clamped is arranged between the clamping surfaces 3 of the clamping strips 2, the clamping strips and a compression strip 6 which is radially displaceable between the clamping strips toward the cylinder periphery. Two or more commercially available hydraulic cylinders 8 are incorporated in each of the inserts, for pressing the clamping strips together; the pressing apart of the clamping strips may be effected by means well known in the art for pressing the clamping strips apart. The last-mentioned hydraulic cylinders are supported at their rear on the cylinder wall via the inserts.

The plate 9 to be clamped is provided in the region of its ends with edge claws 10 which are bent over at an acute angle and grip the clamping surfaces.

When the edge claws are pressed against the associated clamping surface 3, the plastic tube 7 which is arranged in the clamping channel 4 and is filled with a sealing material is deformed on the one hand by the clamping strips 2 and on the other hand by the compression strip 6 in such a way that the sealing material is forced through the above-mentioned openings in the plastic tube toward the outer contour of the cylinder. During the clamping operation a shaping piece 12 which forms the upper limit of the gap closure is located above the outer contour in the gap region. The compression strip also fulfils a second function, i.e. it ejects the deformed plastic tube 7 from the cylinder when the plate is changed, i.e. when a new plate is clamped on the cylinder. The return stroke of compression strip 6 is limited by a stop element 11.

We claim:

1. An apparatus for clamping a printing plate for rotary printing presses on a cylinder having a recess with opposite inner walls, said plate, when in place on said cylinder, having two adjacent ends with a gap therebetween, and each of said ends terminating in a bent-over edge claw, said apparatus comprising:

at least two clamping strips which are laterally displaceable in the cylinder recess, which each has a pressure surface engaging one of said bent-over edge claws and an outer curvature of which corresponds to the curvature of said cylinder, a resilient strip insertable between the pressure surfaces of the clamping strips, said resilient strip being in the form of a plastic tube or hose which is filled with a sealing material and has openings extending radially in the direction of said gap;

a compression strip which is displaceable radially in the direction of said gap and into contact with said tube or hose to compress said tube or hose in the last-mentioned direction and thereby cooperate with said clamping strips in causing said sealing material to be expelled from said tube or hose in said direction; at least two hydraulic cylinders, one for each of said clamping strips, for pressing said clamping strips toward each other, said hydraulic cylinders each having one end bearing against one of said inner walls and another end engaging one of said clamping strips.

* * * * *